US011565375B2

(12) United States Patent
Cauley, Jr. et al.

(10) Patent No.: US 11,565,375 B2
(45) Date of Patent: Jan. 31, 2023

(54) SHARPENING DEVICE

(71) Applicant: AOB Products Company, Columbia, MO (US)

(72) Inventors: Dennis W. Cauley, Jr., Fayette, MO (US); James Tayon, Moberly, MO (US); Anthony Vesich, Columbia, MO (US); Matthew Kinamore, Columbia, MO (US); Curtis Smith, Columbia, MO (US); Josh Neville, Columbia, MO (US); Mark Dalton, Columbia, MO (US)

(73) Assignee: AOB Products Company, Columbia, MO (US)

( * ) Notice: Subject to any disclaimer, the term of this patent is extended or adjusted under 35 U.S.C. 154(b) by 0 days.

(21) Appl. No.: 17/126,242

(22) Filed: Dec. 18, 2020

(65) Prior Publication Data

US 2021/0197343 A1 Jul. 1, 2021

Related U.S. Application Data

(60) Provisional application No. 62/949,725, filed on Dec. 18, 2019.

(51) Int. Cl.
*B24D 15/08* (2006.01)

(52) U.S. Cl.
CPC ..... *B24D 15/08* (2013.01)

(58) Field of Classification Search
CPC .... B24D 15/06; B24D 15/063; B24D 15/065; B24D 15/08; B24D 15/081; B24D 15/082; B24D 15/084; B24D 15/061; B24D 15/10; B24D 15/105; B24B 3/36; B24B 3/52; B24B 3/54; B24B 3/543; B24B 3/605
USPC ..... 451/45, 552, 555–558, 411, 253, 698
See application file for complete search history.

(56) References Cited

U.S. PATENT DOCUMENTS

| | | | | |
|---|---|---|---|---|
| 1,165,245 | A * | 12/1915 | Goodwin | B24D 15/081 76/86 |
| 1,429,984 | A * | 9/1922 | Vollmer | B24D 15/081 76/86 |
| 2,462,176 | A * | 2/1949 | Fryar | B24D 15/06 451/486 |
| 2,674,072 | A | 4/1954 | Lohmann | |
| 3,894,362 | A | 7/1975 | Graves | |
| 4,231,194 | A | 11/1980 | Glesser | |
| 4,259,815 | A | 4/1981 | Kuban | |
| 4,640,058 | A | 2/1987 | Glesser | |
| 4,646,477 | A | 3/1987 | Robertson | |

(Continued)

FOREIGN PATENT DOCUMENTS

| | | | |
|---|---|---|---|
| CN | 104552040 | A | 4/2015 |
| KR | 20100123284 | A | 11/2010 |

*Primary Examiner* — Joel D Crandall
*Assistant Examiner* — Sidney D Hohl
(74) *Attorney, Agent, or Firm* — Stinson LLP

(57) ABSTRACT

A sharpening device, components thereof, and associated methods. The sharpening device includes a sharpening assembly and a housing. The sharpening assembly is selectively receivable in the housing in a stowed configuration and supportable by the housing in an operational configuration to support the sharpening assembly for sharpening a blade. The sharpening assembly can include first and second arms having respective abrasive sharpening surfaces pivotable away from each other about a pivot connection.

29 Claims, 4 Drawing Sheets

(56) References Cited

U.S. PATENT DOCUMENTS

| | | | | |
|---|---|---|---|---|
| D326,989 | S | 6/1992 | Button et al. | |
| D327,402 | S | 6/1992 | Button et al. | |
| D328,847 | S | 8/1992 | Button et al. | |
| 5,440,953 | A * | 8/1995 | Gangelhoff | B24D 15/081 76/86 |
| 5,477,753 | A | 12/1995 | Branscum et al. | |
| 6,168,509 | B1 | 1/2001 | Presgrove | |
| 6,726,551 | B2 | 4/2004 | Friel, Sr. | |
| 6,881,137 | B2 | 4/2005 | Friel, Sr. | |
| D513,955 | S | 1/2006 | Friel, Sr. | |
| 8,951,098 | B2 | 2/2015 | Jhones | |
| 9,039,494 | B1 * | 5/2015 | Dovel | B24D 15/08 76/82 |
| 9,796,068 | B2 | 10/2017 | Jhones | |
| 9,821,436 | B1 | 11/2017 | Smith | |
| 2009/0088057 | A1 | 4/2009 | Smith | |
| 2009/0156103 | A1 * | 6/2009 | Henry | B24B 3/54 451/224 |
| 2014/0154963 | A1 * | 6/2014 | Jhones | B24D 15/081 29/434 |
| 2015/0128427 | A1 * | 5/2015 | Linn | B26B 13/04 29/446 |
| 2015/0151408 | A1 * | 6/2015 | Jhones | B24D 15/06 29/434 |

* cited by examiner

SHARPENING DEVICE

CROSS-REFERENCE TO RELATED APPLICATION

The present application claims priority to U.S. Provisional Patent App. No. 62/949,725, filed Dec. 18, 2019, which is hereby incorporated by reference in its entirety.

FIELD

The present disclosure generally relates to sharpeners and more particularly to blade sharpeners such as used for sharpening knife blades, scissor blades, and the like.

BACKGROUND

After a knife has been used for some time, a cutting edge of the knife usually becomes dull. The cutting edge can be sharpened using a sharpener.

SUMMARY

In one aspect, a blade sharpening device comprises a first support including a first arm, a second arm, and a first pivot hub. The first and second arms extend away from the first pivot hub in different directions. The first and second arms include respective first and second abrasive sharpening surfaces for sharpening the blade. The blade sharpening device includes a second support including a third arm, a fourth arm, and a second pivot hub. The third and fourth arms extend away from the second pivot hub in different directions. The third and fourth arms include respective third and fourth abrasive sharpening surfaces for sharpening the blade. A pivot connection connects the first and second pivot hubs. The first and second supports are pivotable about the pivot connection to pivot the first and second arms away from each other and pivot the third and fourth arms away from each other to configure the first and second supports in an operational configuration for use in sharpening the blade.

In another aspect, a blade sharpening device for sharpening a blade comprises a housing defining an interior. The housing includes an opening permitting access to the interior. The housing includes at least one receiver different from the opening. The blade sharpening device includes a blade sharpening assembly. The blade sharpening assembly includes first and second arms connected by a pivot connection about which the first arm is pivotable with respect to the second arm. The first and second arms include respective first and second abrasive sharpening surfaces for sharpening the blade. The blade sharpening assembly is configurable in a stowed configuration in which the arms extend alongside each other. The blade sharpening assembly is configurable in an operational configuration in which the arms are pivoted away from each other to present the abrasive sharpening surfaces for use in sharpening the blade. The blade sharpening assembly in the stowed configuration is receivable in the interior of the housing from the opening to arrange the housing and blade sharpening assembly in a stowed arrangement. The blade sharpening assembly in the operational configuration is receivable in the at least one receiver to arrange the housing and blade sharpening assembly in an operational arrangement in which the housing serves as a base to support the blade sharpening assembly extending upward from the housing for use of the first and second abrasive sharpening surfaces to sharpen the blade.

Other objects and features of the present disclosure will be in part apparent and in part pointed out herein.

BRIEF DESCRIPTION OF THE DRAWINGS

Corresponding reference numbers indicate corresponding parts throughout the drawings.

DETAILED DESCRIPTION

Figure 1:
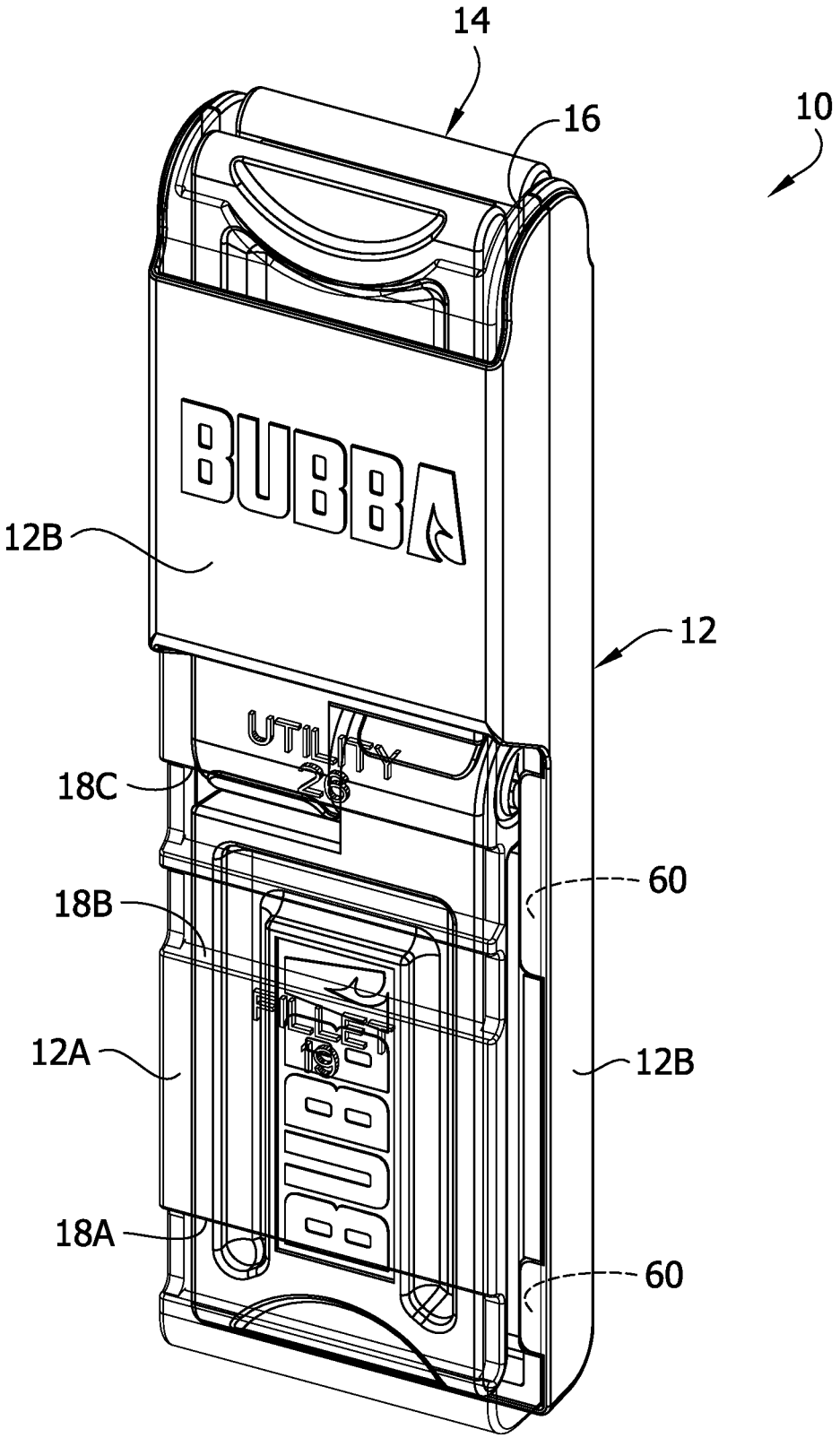
FIG. 1 is a perspective of a blade sharpening device of the present disclosure in a stowed arrangement.
Figure 2:
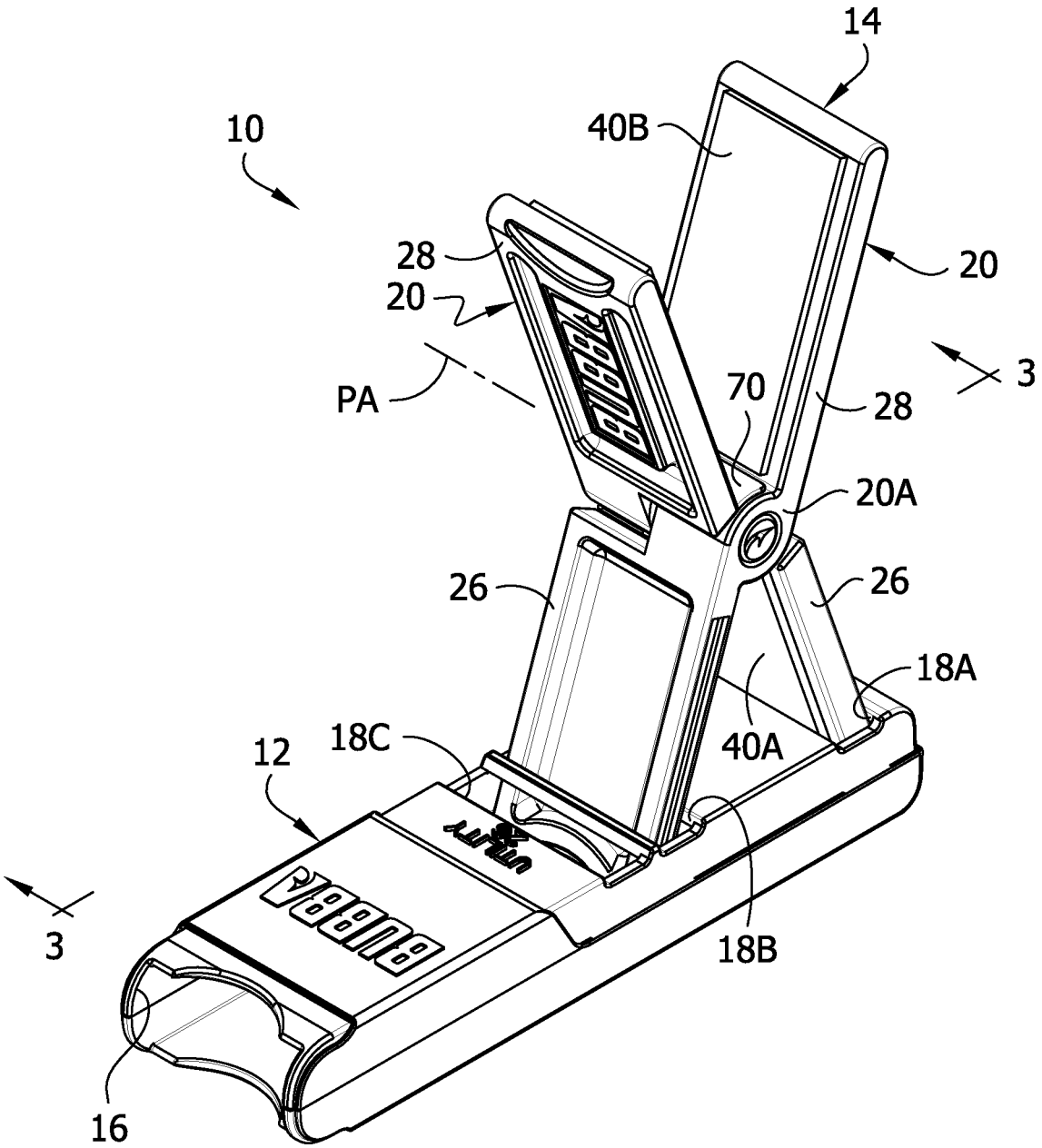
FIG. 2 is a perspective of the blade sharpening device of the present disclosure in an operational arrangement.
Figure 3:
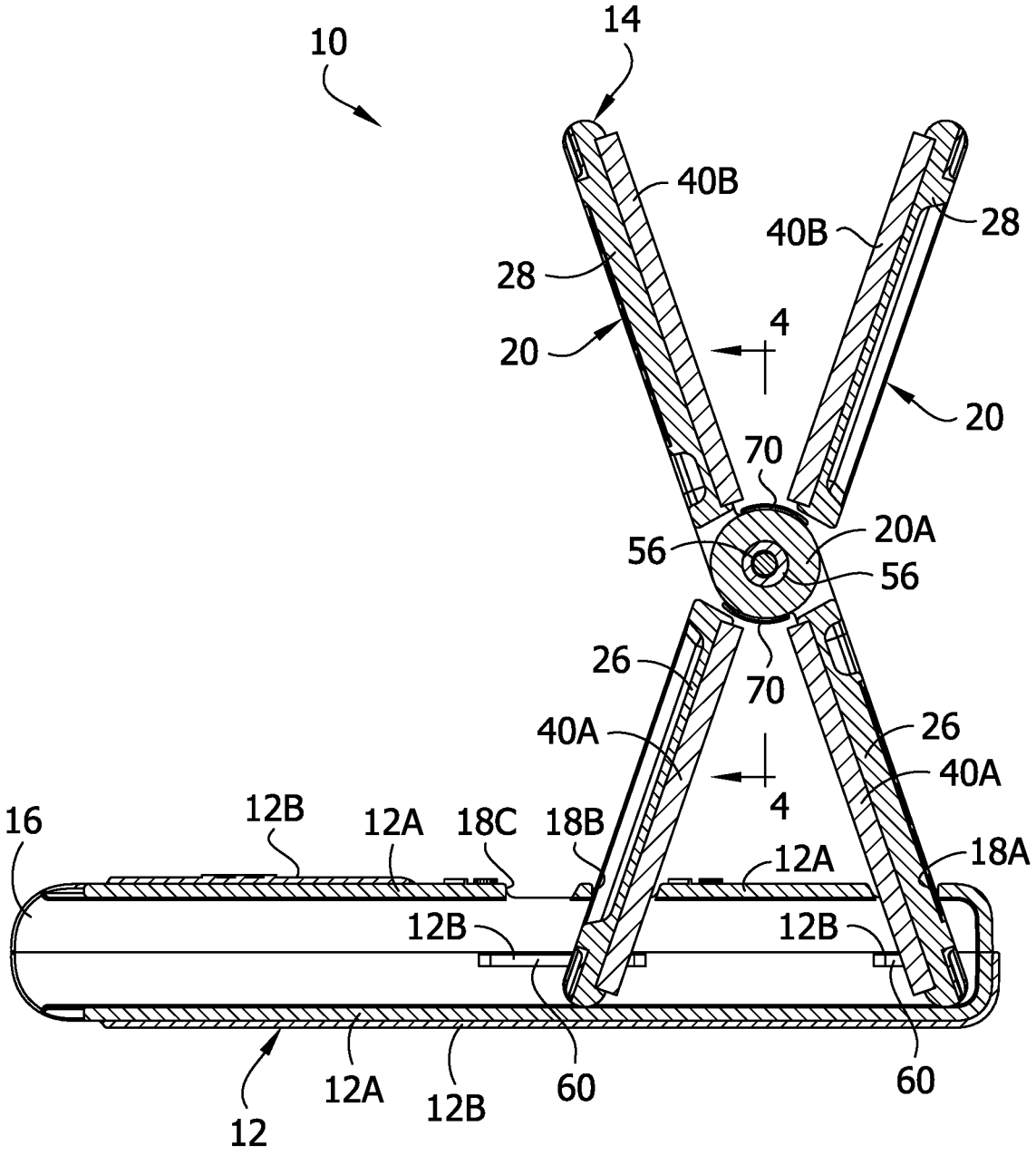
FIG. 3 is a section of the blade sharpening device taken in a plane including line 3-3 of FIG. 2.
Figure 4:
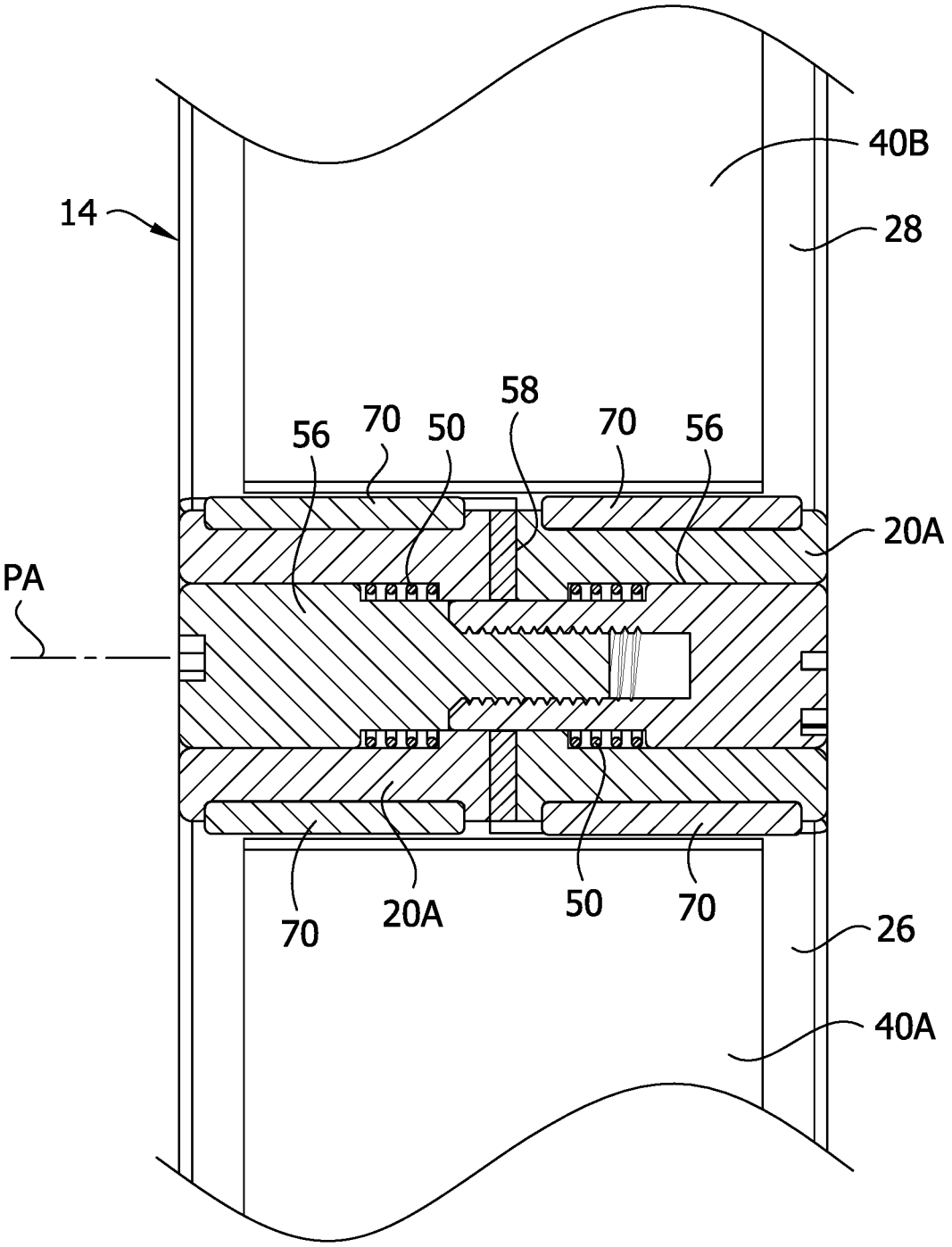
FIG. 4 is a fragmentary section of the blade sharpening device taken in a plane including line 4-4 of FIG. 3.

Referring to FIGS. 1 and 2, a blade sharpening device of the present disclosure is indicated by 10. The blade sharpening device can be used to sharpen various types of blades, such as knife blades and scissor blades, or to sharpen other objects. The blade sharpening device 10 includes a housing 12, which may also be referred to as a base. The blade sharpening device 10 also includes a blade sharpener assembly 14. In a stowed arrangement (e.g., FIG. 1), the blade sharpener assembly 14 is stored in the housing 12, and in an operational configuration (e.g., FIG. 2) the blade sharpener assembly is supported by the housing as a base for use of the blade sharpener in sharpening a blade. The housing 12 defines an interior in which the blade sharpening assembly 14 is receivable via an end opening 16 in the housing to form the stowed arrangement, and the housing includes receivers 18A-18C for receiving and supporting the blade sharpening assembly in the operational arrangement.

The blade sharpening assembly 14 includes a first support 20 and a second support 20. The first and second supports 20 include respective pivot hubs 20A connected to each other by a pivot connection defining a pivot axis PA. The first support 20 includes first and second arms 26, 28 extending in opposing directions away from the pivot connection. Likewise, the second support 20 includes first and second arms 26, 28 extending in opposing directions away from the pivot connection. The arrangement is such that the first arms 26 of the first and second supports 20 form a first pair of arms and the second arms 28 of the first and second supports form a second pair of arms. The pairs of arms 26, 28 are movable toward and away from each other in a scissors fashion by pivoting one or both of the supports 20 about the pivot connection. The blade sharpening assembly 14 is configurable in a stowed configuration by pivoting one or both of the supports 20 about the pivot connection to arrange the respective arms 26, 28 of each pair of arms alongside each other. The blade sharpening assembly 14 is configurable in the operational configuration by pivoting the supports 20 to move the respective arms 26, 28 of each pair of arms away from each other. In the operational configurations, the supports 20 form a generally X shape.

Blade sharpeners 40A, 40B are provided on the arms 26, 28 for sharpening opposite sides of a blade. In the illustrated embodiment, the sharpeners 40A, 40B comprise rectangular sharpening stones that have generally planar abrasive sharpening surfaces. Other types of sharpeners can be used without departing from the scope of the present disclosure. The abrasive sharpening surfaces of the sharpeners 40A on the first pair of arms 26 have a first grit (e.g., coarse grit, such as 400 grit), and the abrasive sharpening surfaces of the sharpeners 40B on the second pair of arms 28 have a second grit (e.g., fine grit, such as 800 grit). For example, the sharpeners 40A on the first set of arms 26 may be used in a first stage of sharpening, and the sharpeners 40B on the second pair of arms 28 may be used in a second stage of sharpening. When in the stowed configuration, the abrasive sharpening surfaces of the respective pairs sharpeners 40A, 40B are immediately adjacent or abutting each other (e.g., in generally flatwise engagement with each other).

It will be appreciated that the supports 20 are configured to permit a compact stowed configuration in which the arms 26, 28 of each pair of arms extend alongside each other, with the abrasive sharpening surfaces opposing each other and being close to each other. In one aspect, arms 26, 28 of one support 20 are located on opposite sides of a reference plane that includes the pivot axis PA and that extends parallel to a length of an abrasive sharpening surface of one of the arms 26, 28. This arrangement results from the arms 26, 28 of a support 20 extending in an offset manner with respect to each other from the pivot hub to which the arms are connected. The construction permits the abrasive sharpening surfaces to be essentially in flatwise face-to-face engagement when the assembly 14 is in the stowed configuration. It will be appreciated as well that the pivot hub 20A of one support 20 is located in a gap of the other support between proximal ends of the other support's arms 26, 28. The pivot hubs 20A are narrower than the arms 26, 28, and the pivot hubs have a combined width about the same as the width of the arms 26, 28.

The base 12 has an elongate shape and includes a lower portion configured to rest on a support surface and an upper portion including the plurality of receivers 18A-18C. The receivers 18A-18C are sized and shaped to receive arms 26, 28 of the blade sharpening assembly 14 to support the blade sharpening assembly in the operational configuration. Depending on whether the user would like to use the first or second pair of sharpeners 40A, 40B, the user can select which pair of arms 26, 28 is installed in the receivers 18A-18C. In the illustrated embodiment, three receivers 18A-18C are provided. Each receiver 18A-18C comprises an opening permitting access into the interior of the base 12. When the blade sharpening assembly 14 is in a receiver 18A-18C in the operational arrangement, the blade sharpening assembly extends into the interior and occupies a portion of the interior that is occupied by the blade sharpening assembly in the stowed arrangement. In a first operational arrangement of the base 12 and assembly 14, arms 26 or 28 of the blade sharpening assembly 14 are received in the first and second receivers 18A, 18B, and in a second operational arrangement, arms 26 or 28 of the blade sharpening assembly are received in the first and third receivers 18A, 18C. The first and second receivers 18A, 18B are arranged such that when the blade sharpening assembly is in the first operational configuration, the abrasive sharpening surfaces of the upper pair of sharpeners 40B are oriented at a first angle (e.g., 19 degrees) with respect to vertical. The first and third receivers 18A, 18C are arranged such that when the blade sharpening assembly is in the second operational configuration the abrasive sharpening surfaces are oriented at a second angle (e.g., 26 degrees) with respect to vertical (greater than the first angle). For example, it may be desirable to sharpen fillet knives using the first operational configuration and to sharpen utility knives or multi-purpose knives using the second operational configuration. Other numbers of operational configurations can be used (e.g., one, three, etc.) can be used without departing from the scope of the present disclosure.

Optionally, the blade sharpening assembly 14 can be configured to prevent the supports 20 from freely pivoting about the pivot connection (e.g., "flopping" open or closed). For example, the supports 20 can be frictionally prevented from freely pivoting about the pivot connection except in response to manual force applied by a user. The blade sharpening assembly 14 can include a pivot damper configured to apply friction to the first and second supports 20 to dampen pivoting movement. In the illustrated embodiment, pivot hubs 20A of the supports 20 are pivotally connected by fasteners 56 threaded to each other, and a washer 58 is provided between the pivot hubs. The pivot damper comprises two compression springs 50 captured between the supports 20 and the fasteners 56. The pivot axis PA of the pivot connection passes through the springs 50. The springs 50 are received over the fasteners 56. First ends of the springs press against pivot hubs 20A of the supports 20, and opposing ends of the springs press against the fasteners 56. The compression of the springs 50 causes the springs to apply a frictional force against the supports 20 at the pivot hubs 20A to prevent gravitational pivoting of the supports and to require manually applied force to pivot the supports about the pivot connection. The compression of the springs 50 and thus the friction applied by the springs (and the force required to pivot the supports 20) can be adjusted by changing the amount the fasteners 56 are tightened to draw heads of the fasteners toward each other. The pivot damper may also be referred to as a retainer which retains the supports in the operational and/or stowed configuration and permits pivoting of the supports under manual pressure applied by a user.

It will be appreciated that the blade sharpening assembly 14 can be supported by the base 12 in the operational configuration with either the first pair of arms 26 extending upward for sharpening with the first pair of sharpeners 40A, or the second pair of arms 28 extending upward for sharpening with the second pair of sharpening stones 40B. The blade sharpening assembly 14 is inverted to present the first or second pair of sharpeners 40A, 40B for use.

To sharpen the blade, the blade is moved downward along the opposing abrasive sharpening surfaces of the upper sharpeners 40B in an alternating fashion to sharpen opposite sides of the blade to form a desired cutting edge. More specifically, the blade can be sharpened by, while holding the knife with the longitudinal axis of the blade extending generally horizontally, with the cutting edge pointing downward and the blade extending vertically from the cutting edge to a back edge of the blade, moving the cutting edge downward across the abrasive sharpening surfaces, alternating between the opposite abrasive sharpening surfaces to sharpen both sides of the cutting edge. Depending on whether the first or second operational configuration is being used, the edge margins of the blade adjacent the cutting edge become beveled at an angle corresponding to the angle of the abrasive sharpening surfaces with respect to vertical. In one method, the blade sharpening assembly 14 is arranged in the selected first or second configuration with the coarse sharpeners 40A to create a coarse bevel at the edge margin adjacent the cutting edge. Then the blade sharpening assembly 14 is flipped over and reinstalled in the base in the same first or second configuration but with the fine sharpeners 40B on top. The fine sharpeners 40B are used in a similar alternating downward strokes on the opposite fine abrasive sharpening surfaces to create a smoother bevel surface at generally the same bevel angle as the coarse bevel, to complete sharpening of the blade.

In another aspect, the housing 12 includes grips 60 to grip the blade sharpening assembly 14 when the blade sharpening assembly is received in the receivers 18A-18C in an operational configuration and to grip the blade sharpening assembly when in the interior of the housing in the stowed configuration. In the illustrated embodiment, the main body 12A of the housing or base 12 is made of plastic material that has a relatively low coefficient of friction. A layer of polymeric material 12B is overmolded onto the main body of the housing 12. The grips 60 are formed by portions of the polymeric material 12B overmolded onto the main body 12A and are exposed in and protrude into the interior of the housing 12. The grips 60 frictionally engage opposing portions of the blade sharpening assembly 12 when the blade sharpening assembly is received in the receivers 18A-18C in the operational configuration and in the housing interior in the stowed configuration. Desirably, the grips 60 provide a tolerance or friction fit with the blade sharpening assembly 14 in the operational and stowed configurations. In the illustrated embodiments, the same grips 60 are used to frictionally engage the blade sharpening assembly in operational and stowed configurations. As a user inserts the arms 26, 28 of the blade sharpening assembly into the receivers 18A-18C or inserts the collapsed blade sharpening assembly 14 into the interior of the housing via the end opening 16, the blade sharpening assembly becomes lodged between opposing grips 60. The grips 60 hold the blade sharpening assembly in position with respect to the housing or base 12 in the operational and stowed configurations. The user can overcome the frictional engagement of the blade sharpening assembly 14 and grips 60 by applying sufficient pulling force to remove the blade sharpening assembly from the receivers 18A-18C or housing interior. The grips 60 facilitate formation of a stable foundation for the blade sharpening assembly 14 with the base 12 when the blade sharpening assembly is received in the receivers 18A-18C in the operational configuration and prevent the blade sharpening assembly from inadvertently exiting the housing when in the stowed configuration.

In yet another aspect, the blade sharpening assembly 14 includes pivot connection structure configured to not damage the cutting edge of the knife blade if the pivot connection structure is unintentionally struck by the cutting edge during sharpening. In particular, the first and second supports 20 include the pivot hubs 20A at which the supports are pivotally connected by the fasteners 56. When the blade sharpening assembly 14 is in an operational position, the hubs 20A define a bottom of a generally V shape formed by the upper arms 28. As the knife blade is moved downward along an abrasive sharpening surface of a sharpener 40B, the user should stop short of the pivot connection structure to avoid contacting the cutting edge of the blade with the pivot connection structure. However, the pivot connection structure includes shields 70 of protective material configured to be contacted by the cutting edge in case of accidental contact of the cutting edge with the pivot connection structure. Desirably, the protective material 70 is configured to be contacted by the blade without substantially dulling or harming the cutting edge. Desirably, the protective material 70 is softer than the material from which the supports 20 are constructed. For example, the supports 20 may be formed of metal (e.g., aluminum), and the protective material 70 can comprise a polymeric material (e.g., synthetic rubber) overmolded onto the supports.

It will be apparent that modifications and variations are possible without departing from the scope of the invention defined in the appended claims.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A blade sharpening device for sharpening a blade, the sharpening device comprising:

a first support including a first arm, a second arm, and a first pivot hub, the first and second arms extending away from the first pivot hub in different directions, the first and second arms including respective first and second abrasive sharpening surfaces for sharpening the blade;

a second support including a third arm, a fourth arm, and a second pivot hub, the third and fourth arms extending away from the second pivot hub in different directions, the third and fourth arms including respective third and fourth abrasive sharpening surfaces for sharpening the blade; and a pivot connection connecting the first and second pivot hubs and defining a pivot axis about which the first and second supports are pivotable, the first and second supports being pivotable about the pivot connection to pivot the first and third arms away from each other and pivot the second and fourth arms away from each other to configure the first and second supports in an operational configuration for use in sharpening the blade;

wherein the first and second arms are configured to pivot conjointly about the pivot connection responsive to pivoting of the first arm;

wherein when the first and second supports are in the operational configuration the first abrasive sharpening surface is offset an angular distance about the pivot axis from the second abrasive sharpening surface.

2. The blade sharpening device as set forth in claim 1, wherein the first and second supports are pivotable about the pivot connection to change from the operational configuration to a stowed configuration, the first and third arms in the stowed configuration extending alongside each other, and the second and fourth arms in the stowed configuration extending alongside each other.

3. The blade sharpening device as set forth in claim 2, further comprising a housing having an opening sized and shaped to receive the first and second supports in an interior of the housing when the first and second supports are in the stowed configuration, the housing including first and second receivers arranged to receive the first and third arms when the first and second supports are in the operational configuration to support the first and second supports for use in sharpening the blade.

4. The blade sharpening device as set forth in claim 1, wherein the first and third abrasive sharpening surfaces are coarser than the second and fourth abrasive sharpening surfaces.

5. The blade sharpening device as set forth in claim 1, wherein the first and second arms are located on opposite sides of a plane that includes the pivot axis and that extends generally parallel to a length of the first abrasive sharpening surface extending away from the pivot connection.

6. The blade sharpening device as set forth in claim 1, wherein the first pivot hub is in a gap between the third and fourth arms.

7. The blade sharpening device as set forth in claim 6, wherein the second pivot hub is in a gap between the first and second arms.

8. The blade sharpening device as set forth in claim 1, wherein the pivot connection includes a pivot damper arranged to cause frictional force on at least one of the first or second pivot hubs sufficient to prevent gravitational pivoting of the first and second supports about the pivot connection when the first and second supports are in the operational configuration.

9. The blade sharpening device as set forth in claim 1, wherein the first and second abrasive sharpening surfaces are rectangular and generally planar.

10. The blade sharpening device as set forth in claim 1, wherein the third and fourth arms are configured to pivot conjointly about the pivot connection responsive to pivoting of the third arm.

11. The blade sharpening device as set forth in claim 1, wherein the first and second arms are fixed to the first pivot hub, and the third and fourth arms are fixed to the second pivot hub.

12. The blade sharpening device as set forth in claim 1, wherein the pivot axis extends between the first and second arms.

13. The blade sharpening device as set forth in claim 12, wherein the pivot axis extends between the third and fourth arms.

14. The blade sharpening device as set forth in claim 1, wherein the first and second supports are pivotable about the pivot connection to pivot the first and fourth arms toward each other and pivot the second and third arms toward each other to configure the first and second supports in the operational configuration.

15. The blade sharpening device as set forth in claim 1, wherein the first and second arms extend generally radially away from the pivot axis in said different directions, and the third and fourth arms extend generally radially away from the pivot axis in said different directions.

16. The blade sharpening device as set forth in claim 1, wherein the angular distance is about 180 degrees.

17. A blade sharpening device for sharpening a blade, the blade sharpening device comprising:

a housing defining an interior, the housing including an opening permitting access to the interior, the housing including at least one receiver opening different from the opening; and a blade sharpening assembly, the blade sharpening assembly including first and second arms connected by a pivot connection about which the first arm is pivotable with respect to the second arm, the first and second arms including respective first and second abrasive sharpening surfaces for sharpening the blade, the blade sharpening assembly being configurable in a stowed configuration in which the arms extend alongside each other, and the blade sharpening assembly being configurable in an operational configuration in which the arms are pivoted away from each other to present the abrasive sharpening surfaces for use in sharpening the blade, the pivot connection connecting the first and second arms to one another in the operational and stowed configurations, the blade sharpening assembly in the stowed configuration being receivable in the interior of the housing from the opening to arrange the housing and blade sharpening assembly in a stowed arrangement in which the blade sharpening assembly is free of reception in the at least one receiver opening, the blade sharpening assembly in the operational configuration being receivable in the at least one receiver opening to arrange the housing and the blade sharpening assembly in an operational arrangement in which the housing serves as a base to support the blade sharpening assembly extending upward from the housing for use of the first and second abrasive sharpening surfaces to sharpen the blade.

18. The blade sharpening device as set forth in claim 17, wherein the blade sharpening assembly is selectively separable from the housing to change the housing and the blade sharpening assembly between the stowed arrangement and the operational arrangement.

19. The blade sharpening device as set forth in claim 17, wherein the at least one receiver opening permits access to the interior, and wherein the housing is constructed such that when the blade sharpening assembly is in the at least one receiver opening in the operational arrangement the blade sharpening assembly extends into the interior and occupies a portion of the interior occupied by the blade sharpening assembly in the stowed arrangement.

20. The blade sharpening device as set forth in claim 19, wherein the housing has an elongate shape and includes an upper portion, a lower portion, opposite first and second ends, and a length extending therebetween, the upper portion including the at least one receiver opening, and the first end including the opening.

21. The blade sharpening device as set forth in claim 17, wherein the blade sharpening assembly includes a first support and a second support, the first support including the first arm, a first pivot hub, and a third arm, the first and third arms extending away from the first pivot hub in different directions, the second support including the second arm, a second pivot hub, and a fourth arm, the second and fourth arms extending away from the second pivot hub in different directions, the pivot connection connecting the first and second pivot hubs.

22. The blade sharpening device as set forth in claim 21, wherein in the stowed configuration the third and fourth arms extend alongside each other.

23. The blade sharpening device as set forth in claim 21, wherein the third and fourth arms include respective third and fourth abrasive sharpening surfaces.

24. The blade sharpening device as set forth in claim 23, wherein the third and fourth abrasive sharpening surfaces are coarser than the first and second abrasive sharpening surfaces.

25. The blade sharpening device as set forth in claim 21, wherein the at least one receiver opening comprises at least first and second receiver openings, and wherein the third arm is receivable in the first receiver opening and the fourth arm is receivable in the second receiver opening to arrange the blade sharpening assembly and the housing in the operational arrangement when the blade sharpening assembly is in the operational configuration.

26. The blade sharpening device as set forth in claim 25, further comprising a third receiver opening, wherein the operational configuration of the blade sharpening assembly is a first operational configuration and the operational arrangement of the blade sharpening assembly and the housing is a first operational arrangement, and wherein the first and second arms are pivotable away from each other to configure the blade sharpening assembly in a second operational configuration in which the first arm is pivoted away from the second arm more than in the first operational configuration, at least one of the third or fourth arm being receivable in the third receiver opening to arrange the blade sharpening assembly and the housing in a second operational arrangement in which the housing serves as the base to support the blade sharpening assembly extending upward from the housing for use of the first and second abrasive sharpening surfaces to sharpen the blade.

27. The blade sharpening device as set forth in claim 26, wherein the third and fourth arms include respective third and fourth abrasive sharpening surfaces.

28. A blade sharpening device for sharpening a blade, the sharpening device comprising:

a first support including a first arm, a second arm, and a first pivot hub, the first and second arms extending away from the first pivot hub in different directions, the first and second arms including respective first and second abrasive sharpening surfaces for sharpening the blade;

a second support including a third arm, a fourth arm, and a second pivot hub, the third and fourth arms extending away from the second pivot hub in different directions, the third and fourth arms including respective third and fourth abrasive sharpening surfaces for sharpening the blade;

a pivot connection connecting the first and second pivot hubs, the first and second supports being pivotable about the pivot connection to pivot the first and third arms away from each other and pivot the second and fourth arms away from each other to configure the first and second supports in an operational configuration for use in sharpening the blade; and a housing having an opening sized and shaped to receive the first and second supports in an interior of the housing when the first and second supports are in a stowed configuration, the housing including first and second receivers arranged to receive the first and third arms when the first and second supports are in the operational configuration to support the first and second supports for use in sharpening the blade;

wherein the first and second arms are configured to pivot conjointly about the pivot connection responsive to pivoting of the first arm;

wherein the first and second supports are pivotable about the pivot connection to change from the operational configuration to the stowed configuration, the first and third arms in the stowed configuration extending alongside each other, and the second and fourth arms in the stowed configuration extending alongside each other.

29. A blade sharpening device for sharpening a blade, the sharpening device comprising:

a first support including a first arm, a second arm, and a first pivot hub, the first and second arms extending away from the first pivot hub in different directions, the first and second arms including respective first and second abrasive sharpening surfaces for sharpening the blade;

a second support including a third arm, a fourth arm, and a second pivot hub, the third and fourth arms extending away from the second pivot hub in different directions, the third and fourth arms including respective third and fourth abrasive sharpening surfaces for sharpening the blade; and a pivot connection connecting the first and second pivot hubs, the first and second supports being pivotable about the pivot connection to pivot the first and third arms away from each other and pivot the second and fourth arms away from each other to configure the first and second supports in an operational configuration for use in sharpening the blade;

wherein the first and second arms are configured to pivot conjointly about the pivot connection responsive to pivoting of the first arm;

wherein the first and third abrasive sharpening surfaces are coarser than the second and fourth abrasive sharpening surfaces.

* * * * *